United States Patent [19]

Ishii et al.

[11] 4,401,885

[45] Aug. 30, 1983

[54] PLANAR HEAT GENERATING DEVICE

[75] Inventors: Eiichi Ishii, Ebina; Yoshiaki Mori, Atsugi; Minoru Toyoda, Takatsuki, all of Japan

[73] Assignee: Nippon Valqua Kogyo Kabushiki Kaisha, Tokyo, Japan

[21] Appl. No.: 309,024

[22] Filed: Oct. 5, 1981

[30] Foreign Application Priority Data

Oct. 8, 1980 [JP] Japan ..... 55-142827[U]

[51] Int. Cl.[3] ..... H05B 3/06

[52] U.S. Cl. ..... 219/523; 219/331; 219/505; 219/528; 219/530; 219/541; 219/544; 219/553; 338/22 R; 338/25

[58] Field of Search ..... 219/331, 553, 505, 523, 219/528, 530, 540, 541, 544; 338/22 R, 22 SD, 25, 225

[56] References Cited

U.S. PATENT DOCUMENTS

| | | | |
|---|---|---|---|
| 2,816,207 | 12/1957 | Boggs | 219/523 X |
| 3,748,439 | 7/1973 | Ting et al. | 219/523 X |
| 3,835,434 | 9/1974 | Kahn | 338/22 R |
| 3,914,727 | 10/1975 | Fabricius | 338/22 R |
| 3,995,141 | 11/1976 | Vieau et al. | 219/505 X |
| 4,091,267 | 5/1978 | Grant | 219/544 |
| 4,104,509 | 8/1978 | Bokestal et al. | 219/544 |
| 4,177,446 | 12/1979 | Diaz | 338/22 R X |
| 4,189,700 | 2/1980 | Hill | 219/553 X |
| 4,242,567 | 12/1980 | Carter | 338/22 R X |
| 4,314,230 | 2/1982 | Cardinal | 338/25 X |
| 4,317,027 | 2/1982 | Middleman | 219/553 |
| 4,317,102 | 2/1982 | Vranas | 338/25 |

*Primary Examiner*—Volodymyr Y. Mayewsky
*Attorney, Agent, or Firm*—Stevens, Davis, Miller & Mosher

[57] ABSTRACT

A planar heat generating device is made up of two heat radiating plates having through-holes, heat generating units of positive temperature characteristic material held between the two plates, two lead wires connected to the two plates, and an insulating cover layer of heat resisting synthetic resin which covers the two plates, the heat generating units and the connecting points of the lead wires. Fluid through-holes are formed in the parts of the insulating cover layer which are applied to the through-holes of the plates, so that the heat generated is effectively conducted to the fluid.

7 Claims, 5 Drawing Figures

PLANAR HEAT GENERATING DEVICE

BACKGROUND OF THE INVENTION

This invention relates to planar heat generating devices which are employed in manufacturing chemicals, processing semiconductors and plating, or in heating corrosive fluids in laboratories, and more particularly to a heat generating device which uses heat generating units made of positive temperature characteristic resistance material.

In one example of a conventional planar heat generating device for heating fluid, metal resistors of nichrome or techrome are employed as heat generating units, and these heat generating units are directly covered with heat resisting synthetic resin. In another example, sheathed heaters of such metal resistors are buried in a heat radiating metal plate, which is covered with a heat resisting synthetic resin.

In such conventional heat generating devices, the temperature of the metal parts must be kept lower than the melting point or the deterioration point of the synthetic resin. Accordingly, it is essential to set the electrical capacity of the heat generating units relatively low. Therefore, with the conventional heat generating devices, it takes a relatively long time to raise the temperature of the fluid to a desired value. Especially when a fluororesin is employed, the characteristic of the heat generating units cannot be fully utilized, because the fluororesin is low in heat conductivity although it is excellent in heat resistance and corrosion resistance.

In order to overcome these drawbacks of conventional heat generating devices, a heat generating device has been proposed in which a heat-sensitive sensor is mounted on a heat radiating metal plate to protect the cover of heat resisting synthetic resin and to increase the electrical capacity, and temperature control is effected below the melting point or deterioration point of the synthetic resin. However, the device is still disadvantageous in that only the temperature of the heat radiating metal plate is abruptly raised to operate the heat-sensitive sensor for temperature control, and the synthetic resin cover layer is low in heat conductivity, and therefore it takes a long time to increase the temperature of the fluid to a desired value.

Furthermore, sometimes the synthetic resin cover layer is peeled off the heat radiating metal plate by the heat generated. If this trouble occurs, the heat conducting efficiency is lowered or becomes non-uniform, and sometimes it is impossible to raise the fluid temperature to a desired value.

Since it is necessary to connect lead wires to the heat-sensitive sensor, the heat generating device is intricate in construction. In addition, during the use of the device in a fluid, it is necessary to control the fluid temperature and the heat generating units. Thus, handling the device is rather troublesome.

SUMMARY OF THE INVENTION

Accordingly, an object of this invention is to eliminate all of the above-described difficulties accompanying a conventional heat generating device for heating fluid.

The foregoing object and other objects as well as the characteristic features of the invention will become more apparent from the following detailed description and the appended claims when read in conjunction with the accompanying drawings.

BRIEF DESCRIPTION OF THE DRAWINGS

In the accompanying drawings:

FIG. 5 is a graphical representation showing the temperature increasing characteristic curves of the device according to the invention and of a conventional heat generating device.

DETAILED DESCRIPTION OF THE INVENTION

Figure 1:
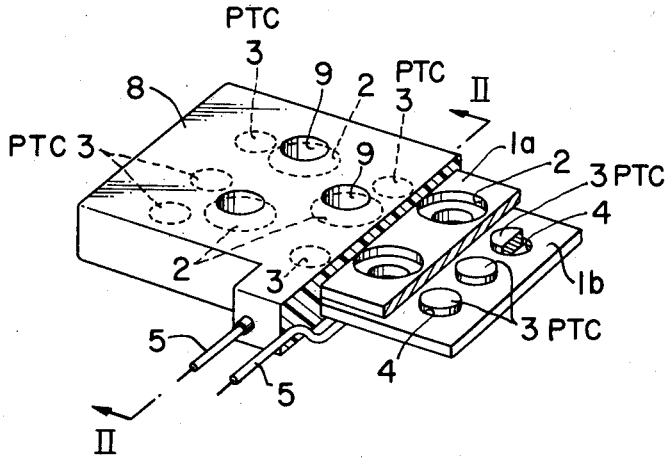
FIG. 1 is a perspective view, with parts cut away, showing a first example of a heat generating device according to this invention.
Figure 1A:
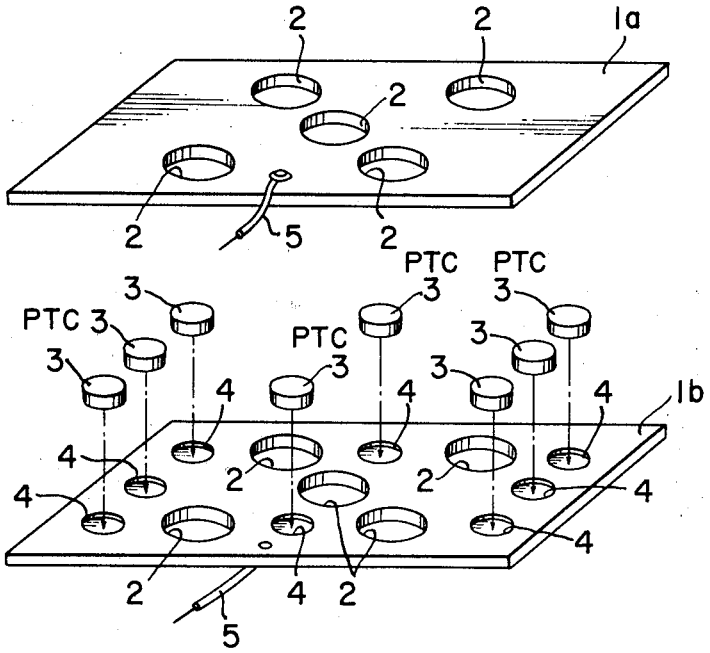
FIG. 1A is a perspective view of portions of the FIG. 1 heat generating device.

A first example of a planar heat generating device according to this invention, as shown in FIG. 1, comprises: two heat radiating plates 1*a* and 1*b* made of metal; and disk-shaped heat generating units 3.

The heat radiating plates 1*a* and 1*b* have a plurality of through-holes 2, and they are placed one on another in such a manner that the through-holes 2 of the plate 1*a* coincide in position with those 2 of the plate 1*b*. The disk-shaped heat generating units 3 are held between the plates 1*a* and 1*b*. Each heat generating unit 3 is made of a positive temperature characteristic resistance material.

Figure 2:
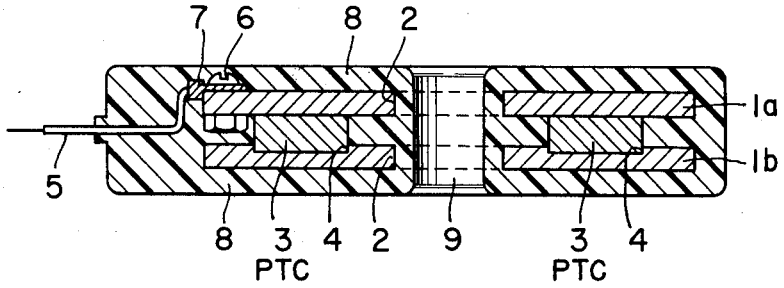
FIG. 2 is a sectional view along the line II—II of the device shown in FIG. 1.

The heat generating units 3 may be merely held between the two heat radiating plates 1*a* and 1*b* as described above. Alternatively, they may be held according to the following method. As shown in FIG. 2, recesses 4 are formed in one of the heat radiating plates 1*a* and 1*b*, and the heat generating units 3 are fitted in the recesses 4 thus formed, respectively. Thereafter, the other heat radiating plate is placed over the heat generating units in the one heat radiating plate. In this case, the heat generating units 3 can be readily positioned.

The heat radiating plates 1*a* and 1*b* are used to improve the heat radiation effect of the heat generating units 3 and serve as the electrodes of the heat generating units 3. Therefore, the heat radiating plates 1*a* and 1*b* are made of a metal plate such as an aluminum, copper, iron or stainless steel plate which is high in thermal conductivity. It is preferable to form the heat radiating plates with aluminum casting, because the heat radiating plates thus formed are small in weight and large in mechanical strength.

The heat generating unit 3 is made of a positive temperature characteristic resistance material such as a barium titanate ($BaTiO_3$) series ceramic semiconductor material. Therefore, upon application of voltage, the unit 3 generates heat. As the temperature increases, the electrical resistance is considerably increased, whereby the temperature is automatically controlled. As the resistance abrupt-increase start temperature (or the Curie point) of the positive temperature characteristic resistance material can be suitably selected, the temperatures can be set to a desired value.

Referring back to FIGS. 1 and 2, two lead wires 5 and 5 are connected to the heat radiating plates 1*a* and 1*b*. More specifically, the end portions of the lead wires 5 are connected to terminals 7 which are secured to the edges of the heat radiating plates 1*a* and 1*b* with screws 6, respectively. The lead wires 5 are electrical wires which are covered with a heat resisting synthetic resin such as a fluororesin.

The two heat radiating plates 1*a* and 1*b* and the heat generating units 3 therebetween are molded by an insulating cover layer 8 of heat resisting synthetic resin. More specifically, the surfaces of the two heat radiating plates 1*a* and 1*b*, the peripheral sides of the heat generating units 3 and the through-holes 2 in the heat radiating plates are all covered by the insulating cover layer 8. Furthermore, the connecting parts of the lead wires 5 are also covered by the insulating cover layer 8.

After the plurality of heat generating units 3 are interposed between the two heat radiating plates 1*a* and 1*b* to which the lead wires 5 have been connected, the insulating cover layer 8 is formed by transfer molding, injection molding or compression molding in such a manner that it covers all of the above-described components. By the formation of the insulating cover layer 8, the heat generating units 3 are positively held by the heat radiating plates 1*a* and 1*b* and the heat generating units 3 are electrically connected to the heat radiating plates.

The insulating cover layer is made of heat resisting synthetic resin such as fluororesin, silicone resin, epoxy resin, polyester resin, polyether resin or polysulfide resin. Among these heat resisting synthetic resins, the use of a fluororesin excellent in heat resistance and corrosion resistance is most preferable. Therefore, tetrafluoroethylene resin (PTFE melting point 327° C., tetrafluoroethylene-perfluoroalkylvinylether copolymer (PFA melting point 302° to 310° C.), tetrafluoroethylene-hexafluoropropylene copolymer (FEP melting point 253° to 282° C.), ethylene-tetrafluoroethylene copolymer (ETFE melting point 270° C.) or fluorovinylidene PVDF melting point 170° C.) is used.

If the insulating cover layer 8 is formed of the fluid which is obtained by heating the aforementioned PFA with tetrafluoroethylene resin covered wires as the lead wires 5, then the PFA is welded to the lead wires, and accordingly the insulating cover layer 8 and the lead wires are formed into one unit.

With respect to the heat generating units 3 and the insulating cover layer 8, the Curie point of positive temperature characteristic resistance material for forming the heat generating units 3 is preferably set to about the melting point of the material which forms the insulating cover layer 8. In order to set the Curie point, the melting point of the insulating cover layer 8, the kind and the quantity of the heated fluid, and the heating temperature and the heating time of the fluid should be taken into consideration.

Fluid through-holes 9 are formed in the insulating cover layer 8 as shown in FIG. 1 or 2. The fluid through-holes 9 are smaller in diameter than the through-holes 2 in the heat radiating plates. The fluid through-holes 9 may be provided for all the through-holes 2, respectively, or a desired number of fluid through holes 9 may be formed.

In the above-described example, the heat radiating plates 1*a* and 1*b* are rectangular; however, the configuration of the plates 1*a* and 1*b* may be changed as desired according to the configuration and construction of a container containing fluid to be heated by the heat generating device. Furthermore, if the surface of the insulating cover layer is modified into a corrugated or saw-tooth-shaped one, then the contact area with fluid to be heated is increased, whereby the heat diffusion efficiency can be increased.

In heating fluid with the planar heat generating device of the invention, a commercial of 100 volts is applied to the lead wires 5 and 5, so that current is applied to the heat generating units 3 from the heat radiating plates 1*a* and 1*b*, as a result of which the heat generating units 3 generate heat. The heat thus generated is conducted through the heat radiating plates 1*a* and 1*b* and the insulating cover layer 8 to the fluid, to heat the latter.

The heat generating units are made of positive temperature characteristic resistance material, as was described above. Therefore, in the initial period, large current flows in the heat generating units, and accordingly the temperature of the heat generating plates is quickly increased. As the temperature approaches the temperature which is defined by the positive temperature characteristic resistance material, the electrical resistance is increased and accordingly the current is decreased. Thus, the temperature can be maintained constant.

The comparison of the characteristic of the planar heat generating device according to the invention with that of the conventional heat generating device will be described with reference to FIG. 5.

FIG. 5 is a graphical representation indicating temperature increasing curves which are obtained by plotting, under the conditions that a planar heat generating device is put in oil of 5 l and 100 volts is applied to the device, the variations of oil temperature with time. In FIG. 5, the curve A is for the heat generating device of 500 Watts according to the invention in which five heat generating units obtained by setting barium titanate ceramic material to 300° C. are held between two heat radiating plates of aluminum, and these elements are covered with a PFA insulating cover layer, and the curve B is for the conventional heat generating device a 500 Watts nichrome sheath heater is buried in a heat radiating plate of aluminum, and these elements are covered with a PFA insulating cover. The curve C shows current values with respect to the curve A.

As is apparent from FIG. 5, the time required for the heat generating device of the invention to increase the oil temperature to 150° C. is only a half ($\frac{1}{2}$) of that required for the conventional heat generating device to do the same. In order to increase the oil temperature to 180° C., the device of the invention needs only about 50 minutes, while the conventional device needs at least two hours. Thus, the device of the invention can increase the oil temperature to a desired value in much shorter time than the conventional device. Furthermore, in the case of the heat generating device according to the invention, the current is abruptly decreased as the oil temperature increased, which makes it possible to maintain the oil temperature constant.

In the heat generating device of the invention, the heat generating units are held by two heat radiating plates, these elements are covered with the insulating cover layer, and the insulating cover layer is extended into the through-holes in the heat radiating plates. Therefore, the insulating cover layer is strongly combined with the heat radiating plates. Furthermore, as the heat generating units are positively and tightly held by the two heat radiating plates, the heat generated by the heat generating units can be radiated quickly and efficiently.

According to the invention, the fluid through-holes are formed in the parts of the insulating cover layer which extend into the through-holes in the heat radiating plates. Therefore, the fluid heated is moved through the fluid through-holes; that is, a convection phenomenon occurs through the fluid through-holes, which quickly heat the fluid.

Unlike the conventional heat generating device, the heat generating device of the invention needs no heat-sensitive sensor to increase the electrical capacity. Accordingly, the device of the invention is small in weight and size and simple in configuration.

Figure 3:
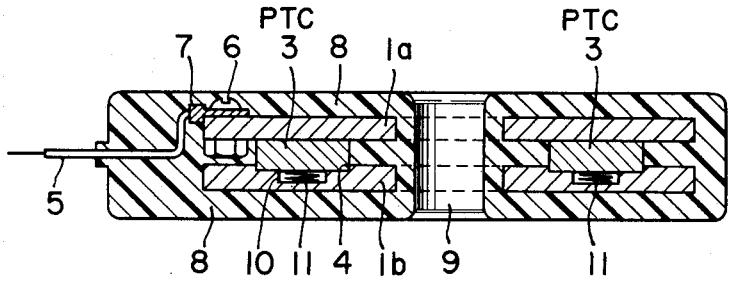
FIG. 3 is a sectional view of a second example of the heat generating device according to the invention.

FIG. 3 shows another example of the heat generating device according to the invention. In this example, as shown in FIG. 3, the heat generating unit 3 is fitted in the recess 4 formed in the heat radiating plate 1*b*, and a recess 10 small in diameter is cut in the bottom of the recess 4, so that a metal spring 11 such as a coil spring or a corrugated leaf spring is provided in the recess 10, whereby the heat generating unit 3 is held by the heat radiating plates 1*a* and 1*b* this way.

In this example, the heat generating units are more tightly held by the heat generating plates by means of the metal spring 11. The spring 11 is fitted, under compression, in the recess 10 which is formed in the recess 4, so that the plates 1*a* and 1*b* are brought into contact with the PTC 3 under suitable pressure so that the former are electrically connected to the latter. In order to postively maintain the electrical connection, the plates 1*a* and 1*b*, the PTCs 3 and the springs 11 are held fixed to one another by the insulating cover layer 8 of the synthetic resin. Furthermore, even if the insulating cover layer is expanded by heat generated by the heat generating units to move the two heat radiating plate apart from each other, the heat generating units are maintained electrically connected to the heat radiating plates satisfactorily at all times.

Figure 4:
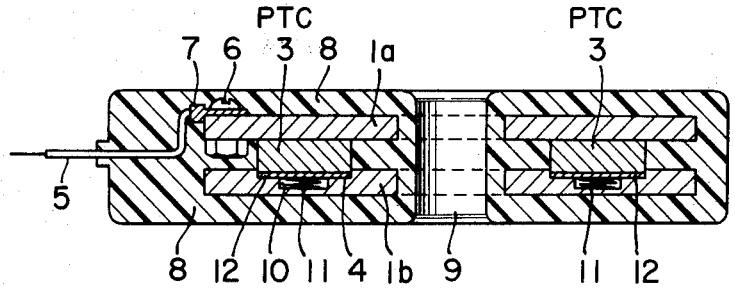
FIG. 4 is also a sectional view showing a third example of the heat generating device according to the invention.

A third example of the heat generating device according to the invention is as shown in FIG. 4. In the example, a thin metal plate 12 is interposed between a heat generating unit 3 and a metal spring 11 to hold the heat generating unit 3 between heat radiating plates 1*a* and 1*b*. In this arrangement, the thin metal plate 12 is brought widely in contact with an aluminum film electrode formed on the heat generating unit 3, and therefore the electrical conductivity therebetween is remarkably improved.

What is claimed is:

1. A planar heat generating device comprising:

two heat radiating plates of metal in which a plurality of through-holes are formed;

a plurality of heat generating units which are held by said two heat radiating plates, said heat generating units being made of positive temperature characteristic resistance material;

two lead wires connected to said two heat radiating plates, respectively; and an insulating cover layer of heat resisting synthetic resin enclosing said two heat radiating plates, said heat generating units and the portions of said lead wires which are connected to said heat radiating plates, fluid through-holes being formed in the parts of said insulating cover layer which are over said through-holes cut in said heat radiating plates, said fluid through-holes being smaller in diameter than said through-holes cut in said heat radiating plates.

2. A planar heat generating device as claimed in claim 1, in which at least one of said heat radiating plates has recesses to receive said heat generating units, whereby said heat generating units are readily positioned between said heat radiating plates.

3. A planar heat generating device as claimed in claim 2, in which each recess formed in said at least one of said heat radiating plates has an additional recess relatively small in diameter to receive a metal spring compressed between a said heat radiating plate and a said heat generating unit.

4. A planar heat generating device as claimed in claim 3, in which a thin metal plate is interposed between said metal spring in said additional recess and a said heat generating unit.

5. A planar heat generating device as claimed in claim 1, in which said two heat radiating plates are made of an aluminum casting.

6. A planar heat generating device as claimed in claim 1, in which said insulating cover layer is made of fluororesin.

7. A planar heat generating device as claimed in claim 1, in which said insulating cover layer is made of tetrafluoroethylene-perfluoroalkylvinylether copolymer, said lead wires are tetrafluoroethylene resin covered electrical wires, and the portions of said lead wires, connected to said heat radiating plates are completely covered by said insulating cover layer.

* * * * *